United States Patent [19]

Lathim

[11] Patent Number: 4,571,881

[45] Date of Patent: Feb. 25, 1986

[54] CHRISTMAS TREE STAND

[75] Inventor: Delbert L. Lathim, Kennewick, Wash.

[73] Assignee: Lathim Industries, Inc., Kennewick, Wash.

[21] Appl. No.: 520,846

[22] Filed: Aug. 5, 1983

[51] Int. Cl.[4] ..... A47G 7/02

[52] U.S. Cl. ..... 47/40.5; 47/48.5; 248/527

[58] Field of Search ..... 47/40.5, 48.5, 77; 403/362; 411/416, 411; 248/527

[56] References Cited

U.S. PATENT DOCUMENTS

| | | | |
|---|---|---|---|
| 1,253,572 | 1/1918 | Buchanan | 403/362 |
| 1,855,762 | 4/1932 | Kaminski . | |
| 2,044,192 | 6/1936 | Templin, Jr. . | |
| 2,337,914 | 12/1943 | Meldrum . | |
| 2,609,169 | 9/1952 | Kroeger . | |
| 2,733,032 | 1/1956 | Farley et al. | 47/40.5 |
| 2,994,498 | 8/1961 | Sager | 47/40.5 |
| 3,302,909 | 2/1967 | Glassman | 47/40.5 |
| 4,126,963 | 11/1978 | Dunbar | 47/40.5 |
| 4,159,096 | 6/1979 | Chase . | |
| 4,261,138 | 4/1981 | St. George Syms | 47/40.5 |
| 4,261,402 | 4/1981 | Stanaitis | 411/416 |

*Primary Examiner*—Robert A. Hafer
*Assistant Examiner*—Bradley M. Lewis
*Attorney, Agent, or Firm*—Wells, St. John & Roberts

[57] ABSTRACT

A Christmas tree stand including an intergal frustum-shaped shell and coaxial tree trunk receptacle. The frustum shell includes an annular flat support surface for engaging a floor surface through a full 360° contact area around the tree trunk. A small central contact surface is also provided at the bottom of the tree trunk receptacle, centered within the confines of the annular support surface. The stand is preferably formed of synthetic resin and includes radial bores extending from the shell to open within the receptacle for receiving threaded thumbscrews. The thumbscrews can be turned to tap the radial bores and to extend radially into the receptacle for clamping against the trunk of a tree held therein.

9 Claims, 5 Drawing Figures

CHRISTMAS TREE STAND

FIELD OF THE INVENTION

The present invention relates to Christmas tree stands.

BACKGROUND OF THE INVENTION

The typical Christmas tree stand involves an assembly including a trunk receptacle and legs or braces mounted to the receptacle and radiating therefrom. The legs usually support the receptacle above the floor surface. This raises the gravitational center of the tree, increasing its tendency to tip. Individual legs oppose tipping only within the area at which they contact the floor. Another problem with such stands has been storage. Often, the legs must be removed to reduce storage space requirements. Dismantling and assembling the stands thus becomes a tedious project and loss of parts becomes a very real possibility.

The above problems have been answered to a limited degree by development of Christmas tree stands that make use of a large planar support surface resting against the floor surface and defining the bottom side of a large water reservoir. A tree trunk receptacle is usually carried above the large support surface. Examples of such stands are found in U.S. Patents 1,855,762; 2,044,192; and 2,337,914.

Examples of improved "leg" type tree stands are shown in U.S. Patents 4,261,138; 4,159,096; and 2,609,169.

Though the stands disclosed in the above-cited references are serviceable, there still remains a need for a unitized Christmas tree stand requiring no significant assembly and, thus, no loose parts. There is also a need for such a stand with improved tree support capability; and that will take up a minimum of storage space, both for the user and for shipping and retailing purposes.

BRIEF DESCRIPTION OF THE DRAWINGS

A preferred form of the present invention is illustrated in the accompanying drawings in which.

DETAILED DESCRIPTION OF A PREFERRED EMBODIMENT

Figure 1:
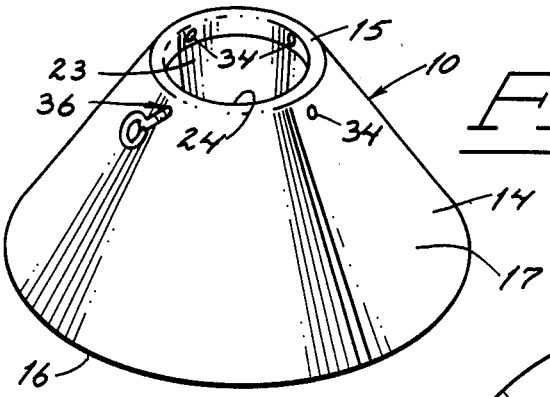
FIG. 1 is a pictorial view of a Christmas tree stand embodying the principal features of the present invention.

In compliance with the constitutional purpose of the Patent Laws "to promote the progress of science and useful arts" (Article 1, Section 8), applicant submits the following disclosure of the invention.

The Christmas tree stand of the present invention is generally indicated by the reference numeral 10 in the accompanying drawing. The present stand 10, as shown, is preferably a unitized, one piece structure formed of a synthetic resin material such as polyethylene. This material has been used successfully along with injection molding processes to produce the present stand. However, it is conceivable that other materials and forming techniques could result in production of a similar unitized stand.

The stand 10 includes a frustum shaped outer shell 14. The frustum shell 14 extends along an upright central axis from a reduced open top edge 15 to an enlarged bottom edge 16. As shown, these edges are circular and coaxial. Edges 15 and 16 are defined by a continuous wall 17 leading angularly from the bottom edge 16 upwardly and inwardly to the reduced open top edge 15.

A flat annular support surface 19 (FIGS. 3 and 5) is defined at the bottom shell edge 16. The surface 19 lies within a horizontal plane that is perpendicular to the vertical central axis of the frustum shell 14. The flat annular support surface 19 preferably includes a radial thickness dimension that is somewhat greater than that of the thickness for the frustum shell wall 17. This reduces the shell wall thickness requirement and optimizes the surface area for engagement between the support surface 19 and a floor or other surface on which the stand is to rest.

It is important to note that the surface 19 is annular and does not span the entire area enclosed by its perimeter. This is a distinct advantage over "leg" type stands and flat bottom stands. Continuous peripheral support is provided by the annular surface 19 at the area most distant from the upright central stand axis. Any floor irregularities within the area surrounded by support surface 19 will not affect orientation of the stand, causing it to "wobble" as do stands that include large flat support surfaces. Furthermore, the annular nature of the support surface 19, along with the hollow conical nature of the shell 14 facilitates storage or "nesting" of the individual stands when in transit and on display for retail sales.

A tree trunk receptacle 23 is formed integrally with the frustum shell 14. The tree trunk receptacle 23 extends from an open top end 24 that is integrally joined with the reduced top edge 15 of the shell. The open top end 24 is coaxial with the upright central axis of the stand. Receptacle 23 extends from the open top end 24 axially downward to a closed bottom end 25. The closed bottom end 25 is situated axially adjacent to the flat annular support surface 19.

Figure 2:
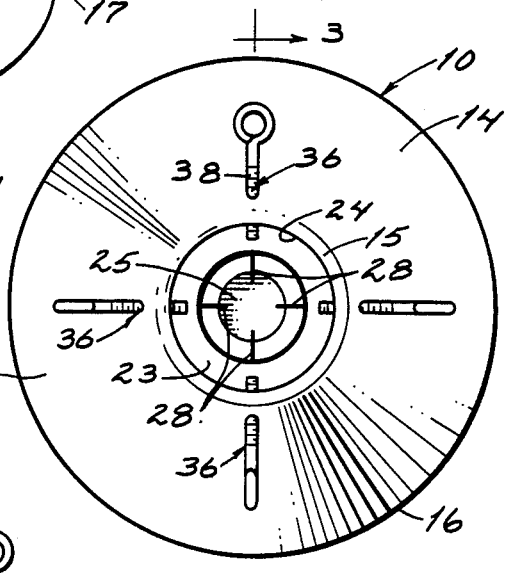
FIG. 2 is a top plan view thereof.
Figure 3:
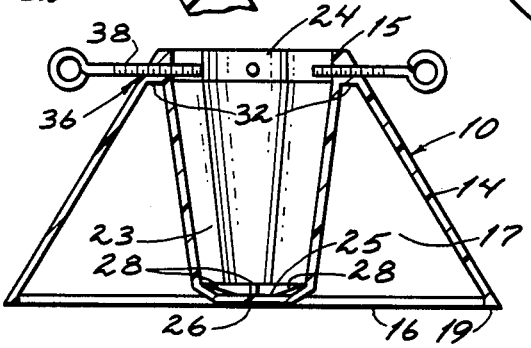
FIG. 3 is a sectional view taken substantially along line 3—3 in FIG. 2.

The receptacle 23, as shown in FIG. 3, tapers substantially along its length to a reduced cross-sectional dimension at the bottom end 25. This feature serves to "center" received tree trunks within the receptacle. The "centering" feature is also facilitated by raised ribs 28 found within the receptacle adjacent the closed bottom end 25. The raised ribs 28 extend from top ends angularly inward and downwardly to the bottom receptacle end 25. They are shown in substantial detail in FIGS. 2 and 3. The raised ribs 28 also function to keep the butt of the tree trunk elevated above the closed bottom receptacle end, thus allowing any water poured into the receptacle to be drawn up through the exposed grain of the tree.

The closed bottom end 25 includes a flat bottom surface 26 (FIGS. 3 and 5) that is preferably coplanar with the flat annular support surface 19 of frustum shell 14. The flat bottom surface 26 therefore functions in conjunction with the shell and annular surface 19 to support the weight of the tree on a floor surface. The contact area between the stand and a floor surface is therefore a small central circular area covered by the flat bottom receptacle surface 26 and a concentric circular area contacted by the flat annular support surface 19.

Both surfaces provide full 360° contact about the central upright axis of the stand.

Figure 4:
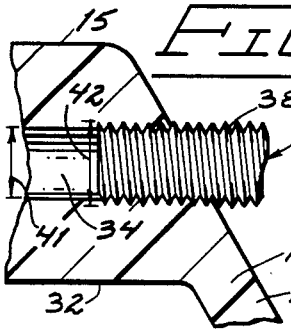
FIG. 4 is an enlarged fragmentary view showing a portion of a tree securing means of the present invention.
Figure 5:
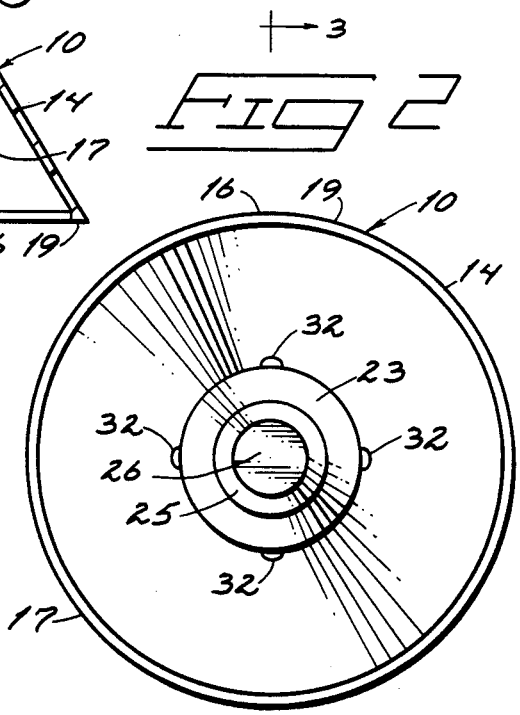
FIG. 5 is a bottom view thereof.

FIGS. 3 through 5 show a number of integral fillets 32 extending horizontally and radially between the inner surface of the shell wall 17 and the receptacle 23. These fillets 32 are provided as reinforcement of areas about the upright stand axis that include radial bores 34 (FIG. 4). The fillets 32 and bores 34 function, along with engaged thumbscrews 38, as a tree trunk securing means 36.

Securing means 36 is selectively operable to engage and clamp against a tree trunk received within the receptacle 23 and hold the trunk stationary relative to the shell and receptacle.

Specific features of a bore 34 and thumbscrew 38 are shown in FIG. 4. There, it may be seen that the diameter 41 of bore 34 is slightly less than the major thread diameter 42 of the associated thumbscrew 38. Due to the nature of the synthetic resin material construction for the stand 10, the threaded shanks of the thumbscrews can be turned into the bores to "tap" the bores 41 and produce mating female threads. This eliminates the need for tapping the bores during the manufacturing process and considerably reduces expense. The length of the tapped bores 41 is sufficient through the shell 14, fillets 32, and receptacle 23 to securely hold the thumbscrews radially and avoid "stripping" of the threads.

The present stand can be manufactured without threadably inserting the individual thumbscrews in place within the bores 41. Instead, the thumbscrews can be supplied within a separate packet (not shown) attached to the interior surface wall of the shell 14 or within the confines of the receptacle 23. This enables the stand to be stored, shipped and retailed in nested stacks. A large number of the present stands can be stored in this manner within a minimal amount of space. This reduces handling and storage costs and, therefore, the overall cost to the consumer.

In operation, the present stand is assembled simply by turning the individual thumbscrews into the bores 34. The turning screws automatically thread or "tap" the bores. Subsequently, a tree can be placed with its trunk extending axially into the receptacle. The thumbscrews are then tightened to clamp against the trunk of the tree and firmly secure the tree in a stationary condition relative to the stand 10. Release of the tree is accomplished simply by turning the thumbscrews in an opposite direction to release the clamping force against the tree trunk.

When the stand is in operation to support a tree, the weight thereof is carried by the peripheral annular support surface 19 and the flat receptacle bottom surface 26. These surfaces provide full 360° support for the tree trunk and brace against any tipping motion or forces applied laterally. The stand will not easily "wobble" due to an uneven support surface because of the relatively small surface area of the floor engaged by surfaces 19 and 26.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A Christmas tree stand formed as a unitary body of synthetic resin by injection molding, comprising:

a hollow conical frustum shell having an inner surface and an outer surface extending between a circular top end and an enlarged circular bottom end formed about an upright center axis;

the bottom end of the shell having a flat annular support edge surface;

a tree trunk receptacle formed integrally and coaxially within the shell, having a wall thickness dimension between an outer surface and an inner surface extending from an open top end and leading to a closed bottom end axially adjacent the bottom edge of the shell;

an annular edge having a thickness dimension between an upper and a lower surface and joining the top edges of the receptacle and conical shell;

wherein the receptacle top edge and shell are unitary and are formed integrally of a synthetic resin;

fillet means internally interconnecting with the shell, top edge and receptacle, radially joining the conical shell and receptacle along the lower surface of the top edge, and spaced about the central axis of the shell for strengthening the shell and receptacle adjacent the top ends thereof by incorporating the thickness dimensions of the receptacle, top edge, and shell integrally with the fillet means as a single structural unit;

radial bores of prescribed diameters extending from open ends flush with the smooth outer shell surface and extending through the shell, fillets, and receptacle to inner openings flush with inner smooth surface of the receptacle; and a metal screw for each bore, having a threaded shank with a prescribed major thread diameter greater than the corresponding prescribed bore diameter, turned axially into the bore such that the threaded shank taps the bore, forming female threads therein.

2. The Christmas tree stand as claimed by claim 1, wherein the flat annular support surface includes a radial thickness dimension greater than the shell thickness.

3. The Christmas tree stand as claimed by claim 1 wherein the tree trunk receptacle is tapered from the diameter of the open top end to a reduced diameter at the closed bottom end.

4. The Christmas tree stand as claimed by claim 1 further comprising raised ribs formed integrally within the receptacle at the bottom end thereof, leading angularly from top rib ends located axially between the top and bottom receptacle ends inward toward the central axis and axially toward the closed bottom end of the receptacle.

5. The Christmas tree stand as claimed by claim 4 wherein the tree trunk receptacle is tapered from the diameter of the open top end to a reduced diameter at the closed bottom end.

6. A Christmas tree stand, comprising:

a unitary piece of synthetic resin formed to include:

a hollow continuously conical frusto-conical outer shell extending between a circular top and an enlarged circular bottom edge; the circular top and bottom edge being defined about an approximately vertical central axis;

a tree trunk receptacle connected to the frusto-conical outer shell; the tree trunk receptacle having an open top end to receive a Christmas tree trunk, and a closed bottom end; the tree trunk receptacle tapering from the open top end to the bottom closed end;

a top edge surface immediately below said circular top of the outer shell, extending between and integrally connecting top portions of the frusto-conical outer shell to top portions of the tree trunk receptacle;

fillet means extending between and integral with the tree trunk receptacle, the hollow frusto conical outer shell and the top edge surface at a point downwardly adjacent to said circular top for strengthening the shell and receptacle adjacent the top ends thereof by integrally incorporating them with the top edge and fillet means below the top edge as a single structural unit; the integral fillet means having approximately radial bores of prescribed bore diameter and of a length extending continuously through the shell, top rim fillet and tree trunk receptacle, for receiving threaded srews therethrough and for maximizing the length of the screws engaged along the length of the bores.

7. The Christmas tree stand of claim 6 further comprising a plurality of threaded metal screws having a major thread diameter greater than the bore diameter of said bores thereby allowing the screws to self-thread into the bores.

8. In a Christmas tree stand including a hollow outer frusto conical shell and an integral receptacle formed axially into the shell from a circular top thereof, an integral tree trunk securing means, comprising:

a top edge integral with the receptacle and shell and defining the top edge of the shell;

fillet means including fillet members formed below the top edge as an integral portion of the shell, top edge, and receptacle such that the material comprising the shell, top rim, and receptacle in the areas joining the fillets are integrated with the fillet members for strengthening the shell and receptacle by incorporating both with the fillet members as a single structural unit;

wherein each fillet member defines a substantially radial bore, extending along a length dimension through the fillet member from an open outward end along that portion of the shell formed integrally with the fillet, member to an open inward end along that portion of the receptacle formed integrally with the fillet; and a screw for each radial bore, threadably engageable therein to extend selectively into the receptacle; and wherein the length dimension of the substantial radial bores includes portions of the receptacle and shell that are integral with the fillet members to maximize purchase within the bores by said screws.

9. The tree securing means as claimed by claim 8, wherein the screws are self-threading, with thread diameters greater than the diameters of the bores.

* * * * *